United States Patent [19]

Juve

[11] 4,170,191

[45] Oct. 9, 1979

[54] AUTOMATIC COATING AND SPIN DRYING APPARATUS

[76] Inventor: Robert J. Juve, 34623 Moravian Dr., Sterling Heights, Mich. 48077

[21] Appl. No.: 819,231

[22] Filed: Jul. 27, 1977

[51] Int. Cl.[2] ..... B05C 5/00; B05C 11/08

[52] U.S. Cl. ..... 118/705; 118/52; 118/303

[58] Field of Search ..... 118/416, 9, 19, 7, 52, 118/418, 6, 303, 64; 134/133, 134, 153, 157; 427/242; 34/126, 128; 198/533; 60/487

[56] References Cited

U.S. PATENT DOCUMENTS

| | | | |
|---|---|---|---|
| 2,720,843 | 10/1955 | Morsey | 60/487 X |
| 2,872,180 | 2/1959 | Tietig, Jr. et al. | 198/533 X |
| 3,357,398 | 12/1967 | Gross | 118/418 |
| 3,382,844 | 5/1968 | Kumpf | 134/134 X |
| 3,456,659 | 7/1969 | Tiby | 134/153 |
| 3,601,088 | 8/1971 | Lacam | 118/64 |
| 3,845,740 | 11/1974 | Ferrara | 118/64 X |

FOREIGN PATENT DOCUMENTS

| | | | |
|---|---|---|---|
| 1151999 | 7/1963 | Fed. Rep. of Germany | 134/134 |

*Primary Examiner*—John McIntosh

*Attorney, Agent, or Firm*—Barnes, Kisselle, Raisch & Choate

[57] ABSTRACT

Automatic coating and drying apparatus wherein a stream of parts or elements is directed from above into an upright perforated basket spinning at low speed, and are simultaneously sprayed with a coating solution. When the basket is full, the loading and spraying cycles are terminated, and the basket is spun at high speed to throw excess solution off of the parts. The basket may be rotated to a position opening downwardly such that the parts spill therefrom into a suitable bin, after which the basket may be returned to the upright position so that the entire cycle may be repeated.

8 Claims, 4 Drawing Figures

AUTOMATIC COATING AND SPIN DRYING APPARATUS

The present invention relates to spin drying apparatus and, more specifically, to automatic apparatus for both coating and spin drying a plurality of individual parts or elements.

In prior art apparatus and techniques for coating and drying a plurality of individual elements such as machine parts, a number of steps are involved, such as loading the parts into a perforated basket and shaking the basket to distribute the load, dipping the loaded basket into a tank of coating solution to wet the parts, placing the dipped basket into a spinning apparatus to dry the parts, and emptying the basket after the parts have been spun dry. Most or all of these steps require manual intervention and the use of a chain hoist or the like. It is a general object of the present invention to provide an apparatus which automatically performs most or, preferably, all of the foregoing functions without manual intervention.

The invention, together with additional objects, features and advantages thereof, will be best understood from the following description when read in conjunction with the accompanying drawings in which.

Figure 1:
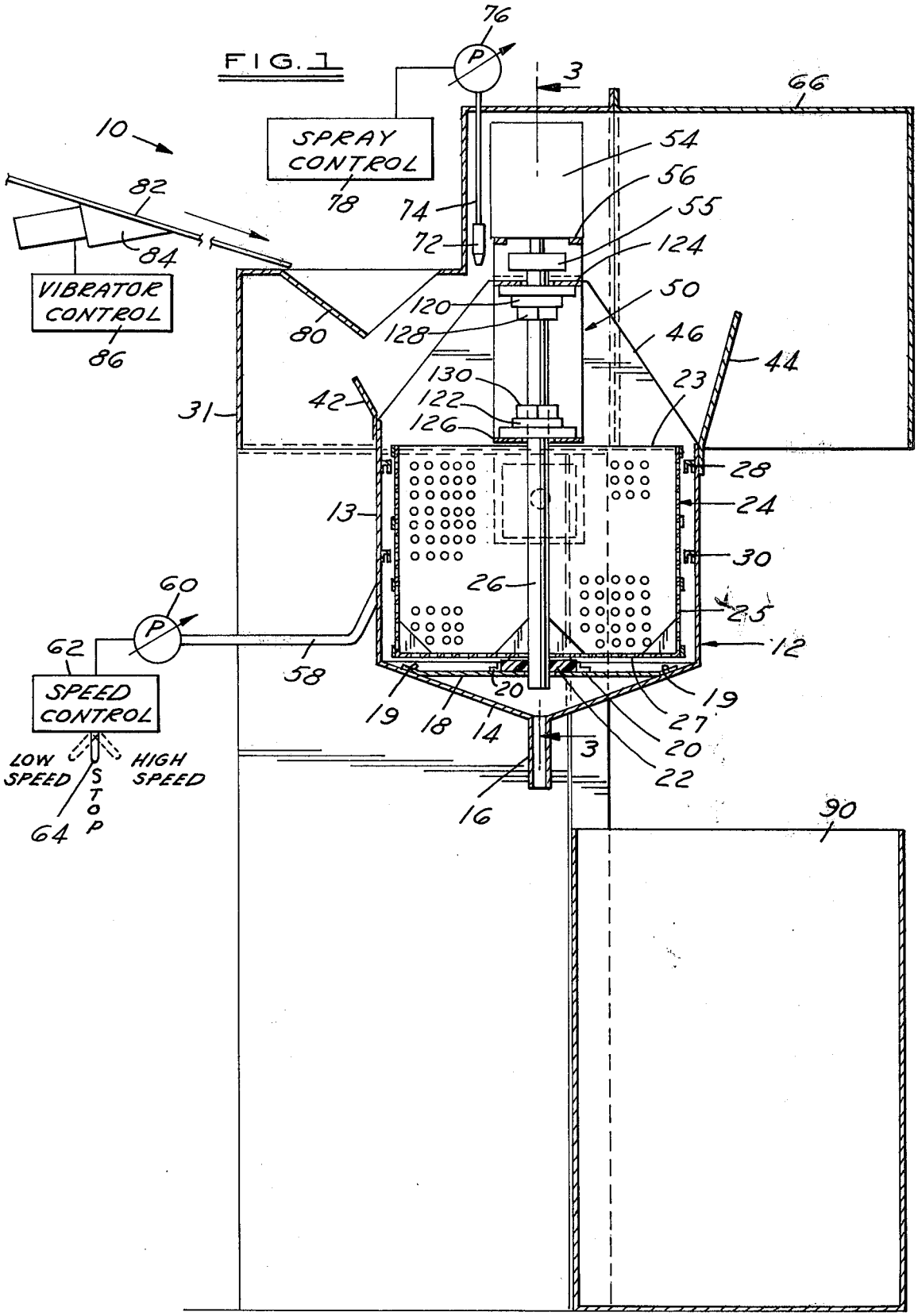
FIG. 1 is an elevational partially schematic view which bisects a presently preferred embodiment of the apparatus provided by the invention.

Referring to the drawings, a presently preferred embodiment 10 of the invention comprises a generally cylindrical basket 24 having an open top 23, and side and bottom walls 25, 27 of perforated sheet metal or suitable screen material. Basket 24 has a shaft 26 extending coaxially therethrough and rigidly coupled to basket bottom wall 27. A lower end of shaft 26 extends from basket bottom 27 through a bearing block 22 of Teflon or other suitable material which supports basket 24 in the upright basket position illustrated in FIGS. 1 and 3. Block 22 is located on a support plate 18 within an enclosure defined laterally by sections 20 of angle iron or the like welded or fastened to the support plate.

An open hollow tank 12 has side walls 13 which coaxially surround side wall 25 of basket 24, and an outwardly dished bottom wall 14 with a drain 16 formed at the nadir thereof. Support plate 18 bridges drain 16 in bottom wall 14 and has ears 19 at either end welded to wall 14, such that basket 24 may spin about its axis within tank 12. An axially spaced pair of inverted channels 28,30 extend entirely around the inside of tank side walls 13. Tank 12 is mounted within a protective enclosure or wall 31 by pins 32,34 (FIG. 3) received by suitable bearings 33,35. Pin 34 extends through bearing 35 and wall 31, and is operatively connected to an electrical motor 36 through a gear reducer 37 and a coupler 39. Gear reducer 37 and motor 36 are mounted and held in fixed position by a bracket 38 on wall 31 to pivot tank 12 about the axis of pins 32,34 perpendicularly to the axis of basket 24. Motor 36 is connected to a suitable control circuit 40 or the like shown schematically in FIG. 3.

Figure 3:
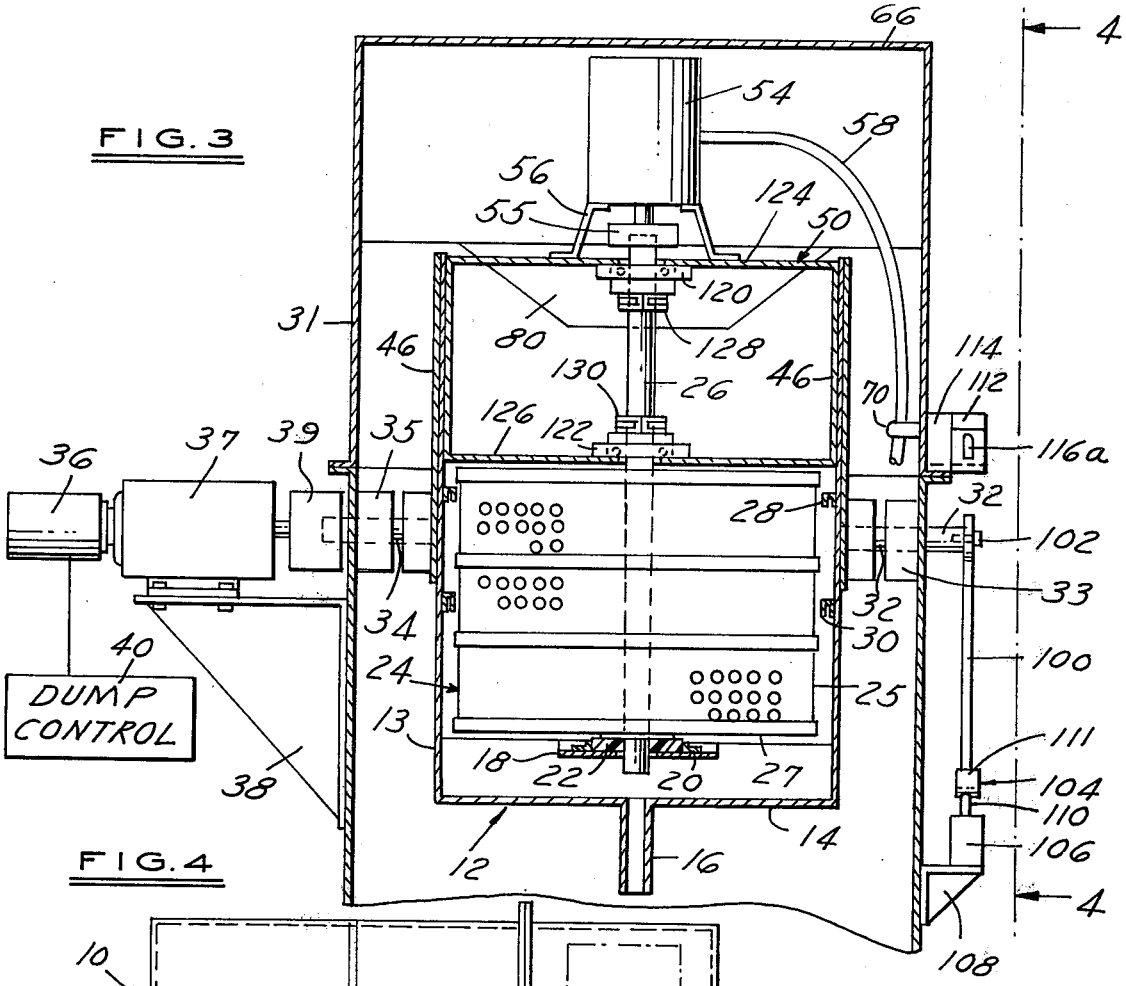
FIG. 3 is a fragmentary sectional view taken along the line 3—3 in FIG. 1.
Figure 4:
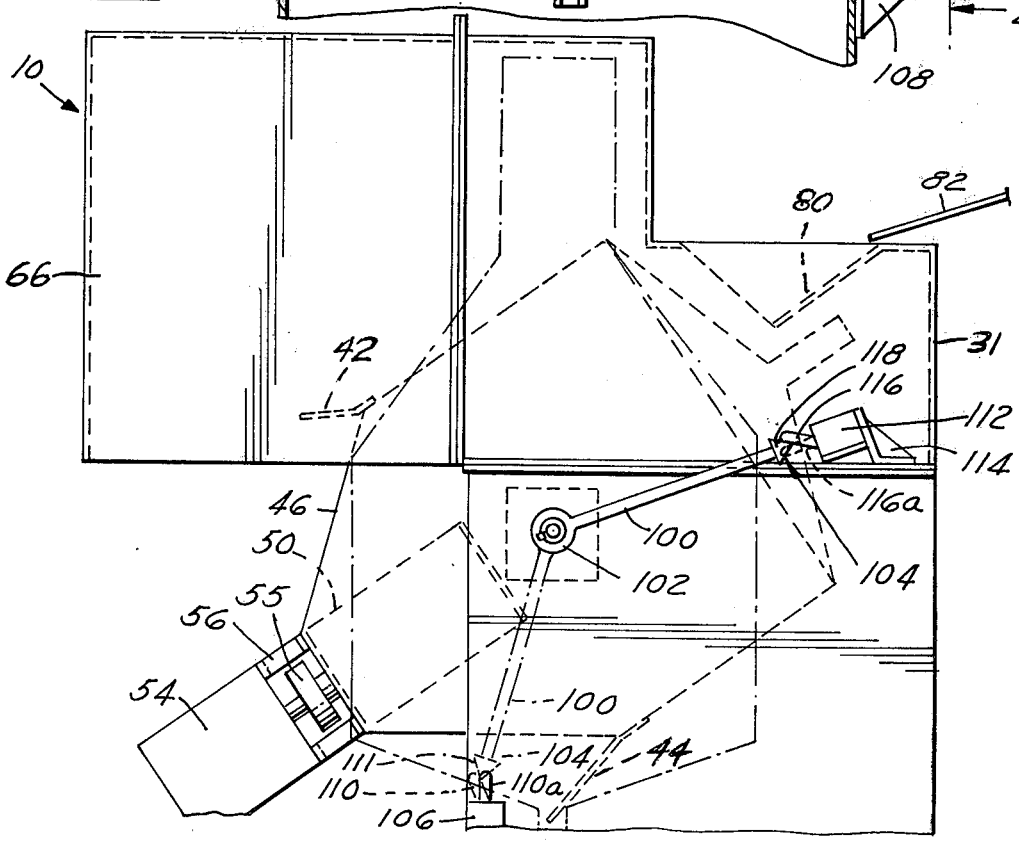
FIG. 4 is a sectional view taken along the line 4—4 in FIG. 3.

As best seen in FIGS. 3 and 4, tank pivot pin 32 extends through bearing 33 and enclosure wall 31. An arm 100 is mounted to the outer end of pin 32 by a bolt 102 and extends radially therefrom to terminate in a generally triangular foot 104 best seen in FIG. 4. A first limit switch 106 is mounted to enclosure 31 by a bracket 108 (FIG. 3) and has a switch arm 110 extending therefrom. Switch arm 110 is spring-biased to a normal position (110*a* in FIG. 4) and is moved to an actuated position (110 in FIG. 4) by abutment with one side 111 of foot 104 in the upright or vertical position of tank 12 and basket 24. A second limit switch 112 is mounted by a bracket 114 to enclosure wall 31 and has an actuator arm 116 extending therefrom. Switch arm 116 is spring-biased to a normal position (116*a* in FIGS. 3 and 4) and is moved to an actuated position (116 in FIG. 4) by abutment with a second side 118 (FIG. 4) of foot 104 in the dump position of tank 12 and basket 24, as will be described hereinafter. Switches 106, 112 are electrically connected to dump control circuit 40 (FIG. 3).

Figure 2:
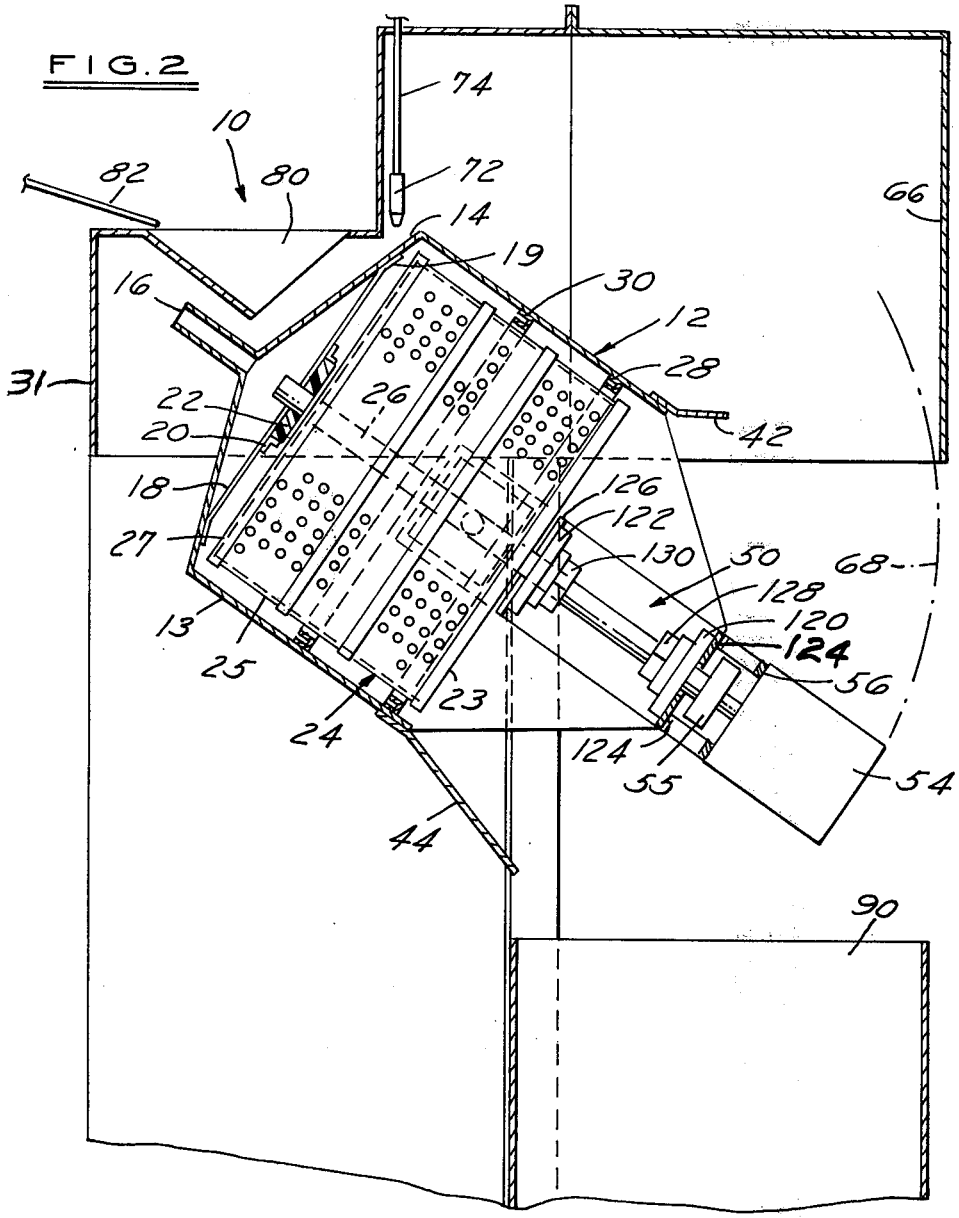
FIG. 2 is a fragmentary view similar to that of FIG. 1 showing the invention during one mode of operation thereof.

A pair of flanges 42, 44 extend upwardly and outwardly from opposed side walls 13 at the open end of tank 12 to guide elements or parts into and out of basket 24 as will be described hereinafter. The other pair of opposite tank side walls extend upwardly at 46 and are connected to each other by an open tie bar 50. Shaft 26 extends through tie bar 50 and is rotatably coupled thereto by a pair of flange bearings 120, 122 respectively internally mounted to the upper and lower walls 124, 126 of tie bar 50. A pair of collars 128, 130 encompass shaft 26 and abut the inner races of bearings 120, 122 to assist the bearings in providing axial or thrust support of basket 24 in the respective dump (FIG. 2) and upright (FIGS. 1 and 3) positions of tank 24. A motor 54 is carried by a bridge 56 mounted on tie bar 50 and is connected directly to shaft 26 by a coupler 55. In accordance with one important aspect of the present invention, motor 54 preferably comprises a variable speed hydrostatic drive motor connected by hydraulic lines 58 to a constant speed variable volume lever-controlled pump schematically illustrated at 60 (FIG. 1). For purposes to be described in detail hereinafter, pump 60 is connected to a speed control circuit 62 having means such as a switch 64 for placing control circuit 62 in alternate stop, low speed and high speed modes of operation. Preferably, speed control 62 further includes suitable means (not shown) for adjusting the level of the high and low motor running speeds. In one working embodiment of the invention, a five horsepower motor 54 and a corresponding pump 60 were purchased as a "K7 Series" combination from Kubik Hydraulics, Inc. of Troy, Mich.

A safety hood 66 is carried by wall 31 around motor 54 and the open ends of basket 24 and tank 12. Hood 66 projects outwardly from wall 31 such that motor 54 may be rotated conjointly with tank 12 and basket 24, as illustrated at 68 in FIG. 2. Hydraulic lines 58 are clamped as at 70 (FIG. 3) to the inside of enclosure 31 near the axis of pins 32,34 so that the hydraulic lines may follow motor 54 without snagging.

A nozzle 72 is mounted on hood 66 above basket 24 and directed downwardly to spray coating solution over parts loaded into the basket. Nozzle 72 is connected by a suitable conduit 74 through a pump schematically illustrated at 76 (FIG. 1) to a coating solution supply (not shown). Preferably such solution supply includes means positioned beneath drain 16 to recirculate solution dripping from or spun off of the coated parts. Pump 76 is connected to a control circuit 78 (FIG. 1) to actuate the pump and nozzle only when parts are being loaded into basket 24.

A funnel opening 80 is provided in hood 66 above the open end of basket 24. An elongated ramp or chute 82 has a sloping upper surface which terminates at its lower end adjacent funnel opening 80. A pneumatic vibrator 84 (FIG. 1) is rigidly coupled to chute 82 and connected to a control circuit 86. The angle of chute 82 with respect to the horizontal preferably is selectively adjusted at slightly less than the angle of repose of the particular parts or elements which are to be loaded into basket 24, such that parts loaded on the upper end of chute 82 will lie at rest on the chute until vibrator 84 is activated, at which time the parts migrate down the cute upper surface and fall in a relatively steady trickle or stream into basket 24. A chute angle of between ten and fifteen degrees has been found adequate for most small machine parts. Funnel 80 cooperates with flange 42 to guide falling parts into the basket.

Operation of the invention proceeds as follows. Parts or elements to be coated are first loaded by suitable means onto the upper region of chute 82. For example, a bin of parts may be lifted and tipped to spill parts onto the chute which may be ten to fifteen feet in total length. With tank 12 and basket 24 in the upright positions shown in FIGS. 1 and 3 and in phantom in FIG. 4, vibrator 84 is then actuated by control circuit 86 to provide a steady trickle of parts into basket 24 as hereinabove described. At the same time, pump 76 is activated to spray parts spilling into basket 24 with coating solution, and basket 24 is spun at a low first speed by motor 54 actuated through pump 60 and control circuit 62. Chute 82, nozzle 72 and motor 54 operating at low speed, together with corresponding control elements, thus cooperate to spray the elements with coating solution as they are loaded and simultaneously to distribute the loaded elements within basket 24 evenly about the basket axis.

When a sufficient number of parts are loaded, spray pump 76 and vibrator 84 are turned off. Motor 54 is then operated at high speed by pump 60 and control 62 to spin dry the loaded and sprayed elements. Excess coating solution will be thrown off of the parts by centrifugal force through the perforations in the basket side wall onto tank walls 13, and will flow down the tank walls through drain 16. When the spinnning operation is completed, motor 54 is deactivated and basket 24 comes to a halt. Then motor 36 (FIG. 3) is activated by dump control 40 (FIG. 1) to rotate tank 12, basket 24, motor 54 and actuator arm 100 conjointly clockwise as viewed in FIGS. 1 and 2 about the axis of pins 32, 34 (FIG. 3) to a position illustrated in FIG. 2 and in solid lines in FIG. 4 at which foot 104 actuates switch 112. In this position, basket 24 and tank 12 open generally in the downward direction and the dried parts may spill therefrom across flange 44 into a suitable bin 90 (FIGS. 1 and 2) or the like. Channels 28,30 prevent solution collected on tank side walls 13 from flowing into bin 90. When the dumping operation is complete, the basket, tank, motor and actuator arm are rotated conjointly counterclockwise as viewed in FIGS. 1 and 2 until foot 104 actuates switch 106. Thus, arm 100 cooperates with switches 106,112, dump control circuit 40 and motor 36 to position basket 24 and tank 12 in the load and dump positions. With the tank and basket in the upright starting position, the entire cycle as hereinabove described may be repeated.

Although motor speed control 62, spray control 76, vibrator control 86 and dump control 40 have been illustrated schematically in FIGS. 1 and 3 as separate elements, such control functions are preferably carried out automatically at a central control station. Such station may utilize any of the usual machine control techniques, such as a conventional programmable drum and associated control relays constructed to operate the automatic coating and drying apparatus in the sequence hereinabove described. Details of such construction will be self-evident to persons skilled in the art. Where the several control functions are embodied in suitable automatic cycling means, the entire operation would require no intervention between the time that the parts are dumped onto chute 82 until bin 90 is full. The necessary durations of the load, spin and dump cycles, the angle of chute 82 and the basket speeds during the load and spin cycles will depend upon the size and geometry of the parts to be coated, and may be determined empirically and then programmed into the control circuit.

In addition to the manifest advantages of the present invention over the prior art multiple-step coating and drying operations hereinabove described, several perhaps more subtle advantages are also presented. In the basket drive arrangement, for example, direct coupling between drive motor 54 and basket 24 provides a more reliable coupling arrangement than do belt and pulley arrangments typical of the prior art. Moreover, such direct coupling is accomplished with relatively simple structure which may be easily and safely rotated with the tank and basket between load and dump position. The use of hydrostatic drive motor 54 and pump 60 provides rapid acceleration and deceleration between the load, spin and dump basket speeds. For example, basket 24 may be spun at a low first speed of ten to fifteen rpm to distribute parts within the basket automatically as they are being loaded, and then accelerated to five hundred fifty rpm, for example, for the drying mode of operation in about one-fourth of the time which would be required by a comparable electric motor. Similarly, the hydrostatic drive mechanism of the present invention may be rapidly decelerated and brought to a stop upon completion of the spin cycle, so that the dumping operation may proceed.

The invention claimed is:

1. Automatic coating and drying apparatus comprising a basket having a basket axis, an open end and perforated side walls; means including drive means mounting said basket to spin about said basket axis; means mounting said basket to rotate about an axis transverse to said basket axis between a first position in which said basket open end is directed upwardly and a second position in which said basket open end is directed generally downwardly; means disposed above said open basket end in said first position of said basket for directing a steady stream of elements into said basket; spin drive means including means for spinning said basket at a low first speed as said element stream is being directed into said basket such that said elements are evenly distributed within said basket about said basket axis and for spinning said basket at a higher second speed when said basket is full centrifugally to dry said elements; means including a nozzle disposed above said open basket end in said first position of said basket to spray solution onto said elements as said element stream is directed into said basket; and control means coupled to said spray means, said spin drive means, said element stream directing means and said basket rotating means to activate said stream directing means, said spray means and said spin drive means at low speed simultaneously to distribute and spray elements as elements are loaded into said basket when said basket is in said first basket position, to activate said spin drive means at high speed to dry elements loaded into said basket, to rotate said basket to said second basket position to empty dried elements from said basket, and then to rotate said basket back to said first basket position.

2. The spin drier set forth in claim 1 wherein said loading means comprises first means carried above said basket having a surface sloping downwardly toward said basket and means operatively coupled to said first means to vibrate said first means such that elements resting on said surface migrate down said sloping surface toward said basket.

3. The spin drier set forth in claim 2 wherein said surface is carried at an angle at which elements will lie at rest on said surface in the absense of vibrations, said drier further comprising means selectively to actuate said vibrator means to load said basket and to deactuate said vibrator means when said basket is loaded.

4. The spin drier set forth in claim 3 wherein said angle is between about ten to fifteen degrees.

5. The spin drier set forth in claim 1 further comprising a tank having side walls which coaxially encompass said basket, an open top and a sloping bottom to drain solution spun from elements in said basket, said basket being mounted to spin within said tank.

6. The spin drier set forth in claim 5 wherein said tank and basket are mounted to rotate conjointly about an axis transverse to said basket axis to a second basket postion at which said open basket end is directed generally in the downward direction and elements in said basket pour from said open basket end.

7. The spin drier set forth in claim 6 further comprising means mounted on the inside of said tank side walls to prevent solution on said tank side walls from draining from said open top in the pivoted position of said tank and basket.

8. The spin drier set forth in claim 1 wherein said control means includes first and second limit switch means and means coupled to said basket to actuate said first and second limit switch means in said first and second positions of said basket respectively.

* * * * *